US005836131A

United States Patent [19]

Viola et al.

[11] Patent Number: 5,836,131

[45] Date of Patent: Nov. 17, 1998

[54] JOIST HANGER

[75] Inventors: Ernest S. Viola, Huntington; Raymond C. Frobosilo, Lido Beach, both of N.Y.

[73] Assignee: Super Stud Building Products, Astoria, N.Y.

[21] Appl. No.: 361,690

[22] Filed: Dec. 22, 1994

[51] Int. Cl.[6] ..... E04B 1/38; E04C 5/00

[52] U.S. Cl. ..... 52/702; 52/712; 52/715

[58] Field of Search ..... 52/702, 712, 715, 52/285.3; 403/232.1, 230

[56] References Cited

U.S. PATENT DOCUMENTS 4,525,972 7/1985 Palacio et al. ..... 52/702 X
5,104,252 4/1992 Colonias et al. ..... 52/702 X
5,403,110 4/1995 Sammann ..... 52/712 X

OTHER PUBLICATIONS

*Sweet's Catalog File, 1982, Products For Residential Construction,* Simpson Company, p. 25, Fig. TA10.

*Primary Examiner*—Creighton Smith
*Assistant Examiner*—W. Glenn Edwards
*Attorney, Agent, or Firm*—Hugh D. Jaeger

[57] ABSTRACT

One piece joist hanger formed of heavy gauge sheet metal for fastening of a steel joist to a supporting member. A horizontally aligned upper tab member aligns to and rests on the supporting member to position the joist hanger during installation and prior to fastening. A horizontally aligned lower tab member allows the joist to simply rest on the lower tab prior to fastening.

14 Claims, 6 Drawing Sheets

JOIST HANGER

CROSS REFERENCES TO CO-PENDING APPLICATIONS

NONE

BACKGROUND OF THE INVENTION

1. Field of the Invention

The present invention is for a joist hanger, and more particularly pertains to a joist hanger which provides for support of the hanger on a supporting member and which provides for support of a joist prior to securation.

2. Description of the Prior Art

Prior art devices often have been of oversimplified construction such as an angular support consisting of merely an angle iron like member or an angle iron like device fashioned in a "L" shape form. These and other joist hanger devices offered no vertical support of the hanger device prior to securation to a sill or rafter member. Construction personnel had to align the hanger device by time consuming measuring or empirically placing the devices. Sometimes the hanger device was prefastened to the end of the joist and then manually aligned to a sill or rafter and then secured thereto while attempting to align and secure at the same time. Each of the above, and other such schemes, were dependent on the workers' ability to successfully hold and at the same time secure a joist to a supporting member. Clearly what is needed is a joist hanger which is self supporting on a support member and which also supports a joist butting up to a support member during the securation process and which provides for alignment of the top surfaces of a joist and a supporting member. The present invention provides such a device.

SUMMARY OF THE INVENTION

The general purpose of the present invention is a joist hanger.

According to one embodiment of the present invention, there is provided a joist hanger constructed of a single sheet of heavy gauge sheet metal material having members which are bent along bend axii. Two planar member portions of the joint hanger are bent at right angles. Tabs at the top and at the bottom of the two planar member portions align at right angles thereto where the uppermost tab extends horizontally to offer joist hanger support and where the lower most tab extends horizontally to offer support to a joist. The joist hanger transfers the joist reaction to either a cold formed or wood framing system.

One significant aspect and feature of the present invention is a joist hanger.

Another significant aspect and feature of the present invention is joist hanger having an upper tab for support of the joist hanger on a supporting member prior to securation.

A further significant aspect and feature of the present invention is a joist hanger having a lower tab for support of a joist prior to securation.

An additional significant aspect and feature of the present invention is the elimination of leveling alignment of the top of a joist with the top of a supporting member.

Still another significant aspect and feature of the present invention is a joist hanger which installs quickly and simply.

Yet another significant aspect and feature of the present invention is a joist hanger which allows one worker to install a joist.

Still another significant aspect and feature of the present invention is a joist hanger which allows top and side fastening of a cold formed C section to a wood formed system.

Another significant aspect and feature of the present invention is the use of left and right joist hangers to custom fit or secure a beam or a joist of two members or more.

Another significant aspect and feature of the present invention is the transfer by the joist hanger of the load on the C section to the supporting wood member. Vertical shear is transferred to the face of the supporting members via screw fastener members, Shear and bending caused by the eccentricity of the connection is transferred by the screw fastener members.

Having thus described embodiments of the present invention, it is the principal object of the present invention to provide a joist hanger having upper and lower support member tabs.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
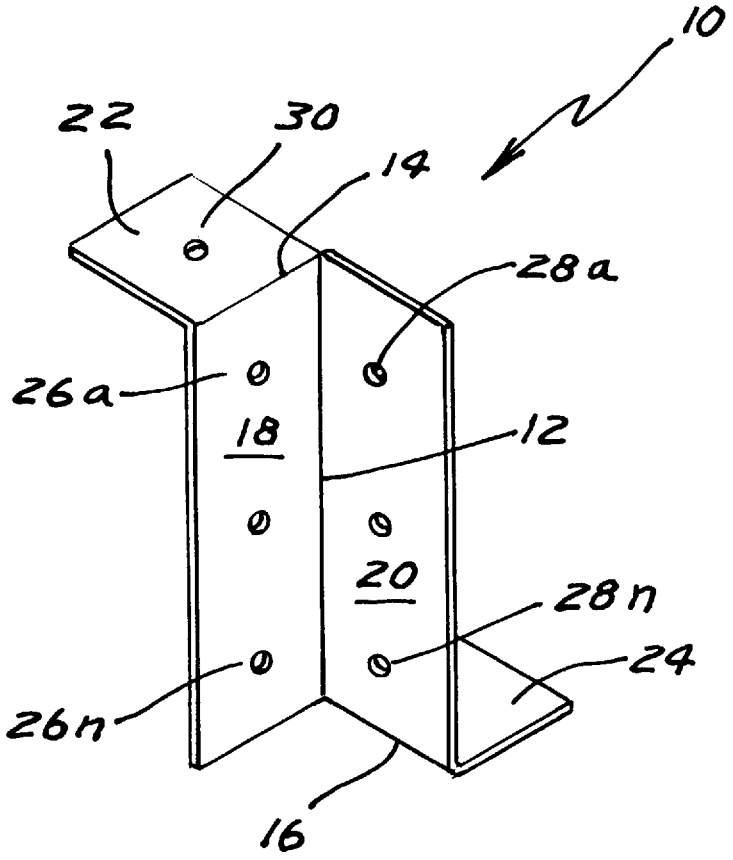
FIG. 1 illustrates a perspective view of a joist hanger, the present invention.

FIG. 1 illustrates a perspective view of joist hanger 10, the present invention. The joist hanger 10 is comprised of heavy gauge sheet metal material formed about a centrally located vertical bend axis 12, upper horizontal bend axis 14 and a lower horizontal bend axis 16. Vertical bend axis 12 intersects the upper and lower horizontal bend axii 14 and 16 at right angles. Planar member 18 and 20 extend vertically and align at right angles to each other about the vertical bend axis 12. An upper planar tab member 22 extends horizontally from the upper horizontal bend axis 14 and at a right angle to the upper region of the planar member 18. A lower planar tab 24 extends horizontally from the lower horizontal bend axis 16 and at a right angle to the lower region of the planar member 20. A plurality of holes 26*a*–26*n* and 28*a*–28*n* align vertically in the planar members 18 and 20 respectively and a hole 30 is located in the upper planar tab member 22.

Figure 2:
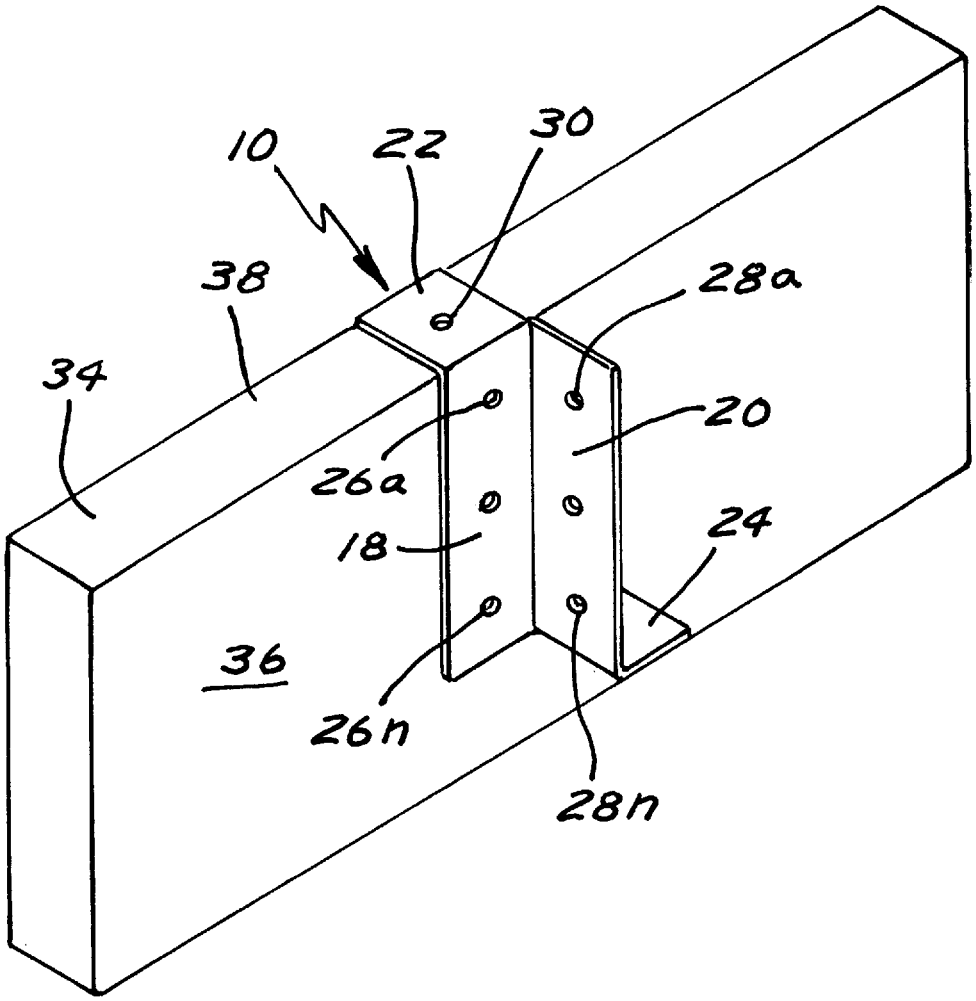
FIG. 2 illustrates a joist hanger aligned and secured to a supporting member.

FIG. 2 illustrates a joist hanger 10 aligned and secured to a sill 34 or other such suitable support structure where all numerals correspond to those elements previously described. The joist hanger planar member 18 is positioned against the vertical surface 36 of the supporting member 34 and the upper planar tab member 22 is positioned against the horizontal surface 38 of the supporting member 34. Suitable fasteners such as nails or screws secure through holes 26*a*–26*n* and 30 to secure the appropriately positioned joist hanger 10 to the supporting member 34. During installation of the joist hanger 10 the upper planar tab 22 supports the joist hanger 10 during alignment of the joist hanger along the supporting member 34. The installation of a fastener through hole 30 can be delayed if desired so that a joist can be accurately positioned along spacing centers.

Figure 3:
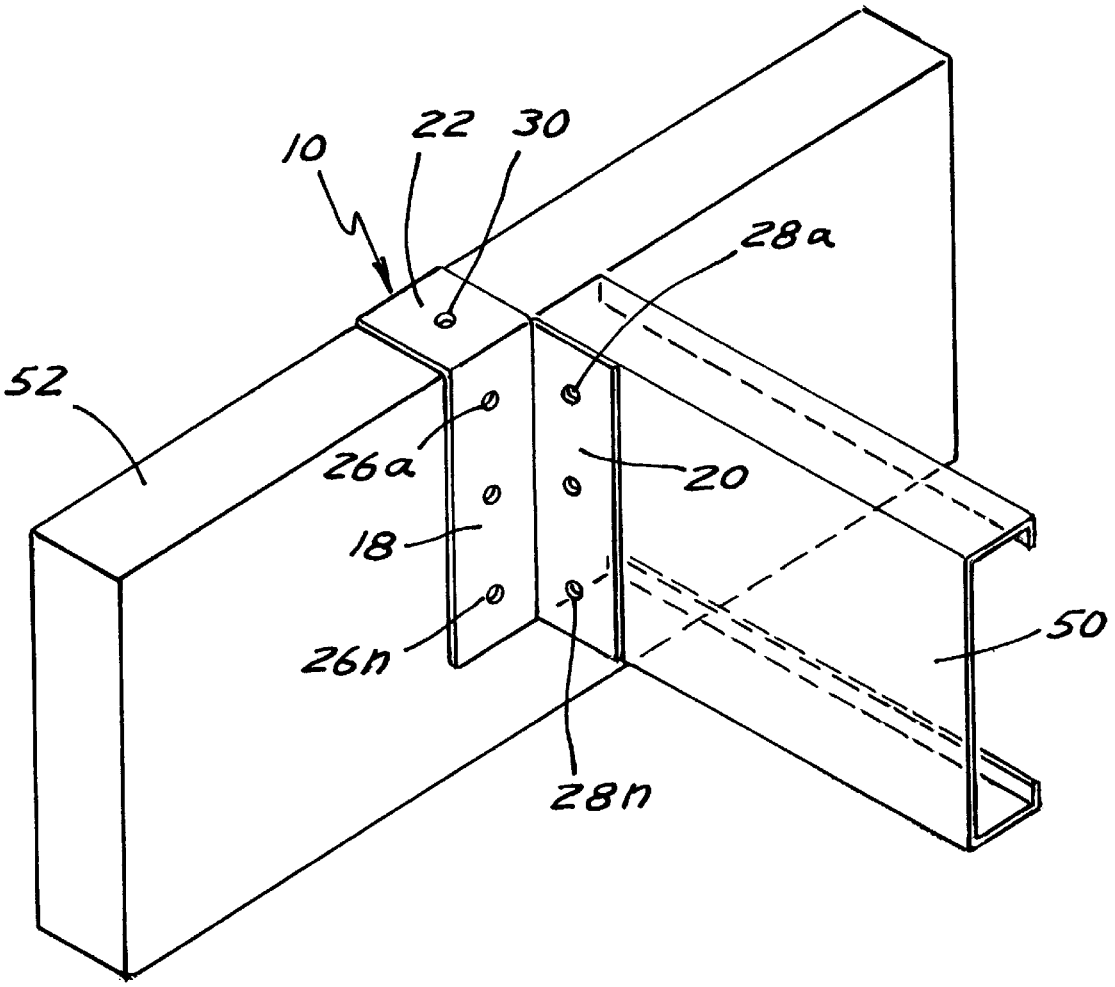
FIG. 3 illustrates a joist hanger securing a metal channel member to a supporting member.

FIG. 3 illustrates the joist hanger 10 securing a metal channel member 50 to a supporting member 52 where all numerals correspond to those elements previously described. The process is much the same as previously described except that sheet metal screws can be passed through holes 28*a*–28*n* into the metal channel member 50, or in the alternative other suitable fasteners such as machine screws or machine screws and nuts could be used for suitable securation.

Figure 4:
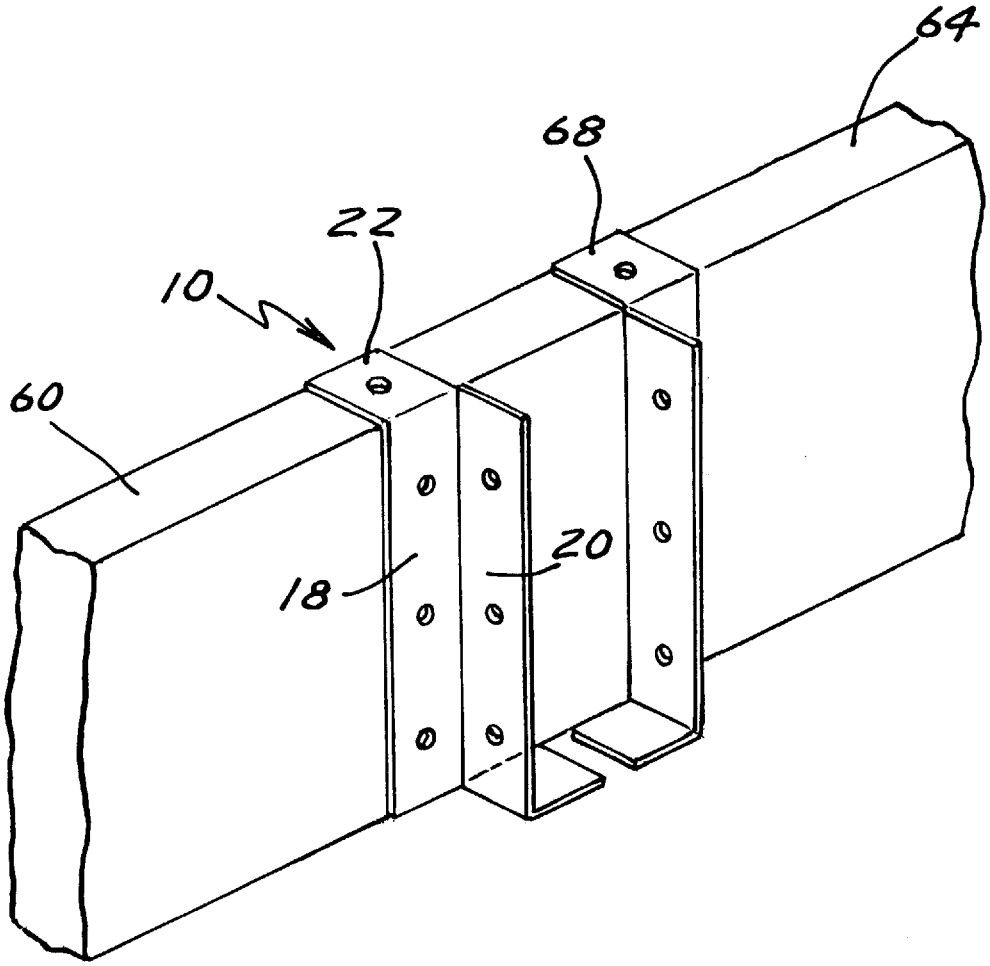
FIG. 4 illustrates two joist hangers aligned to a supporting member for support a double wide joist.

FIG. 4 illustrates two joist hangers aligned and secured to a supporting member 60 for fastening one or more joists to the supporting member 60 where all numerals correspond to those elements previously described. The joist hanger 10 could be designated as a left joist hanger and a joist hanger 62 fashioned in a reverse mirror like image and incorporating the same qualities and features of the joist hanger 10 could be designated as a right joist hanger. The left joist hanger 10 is secured to the sill 60 as previously described and the right joist hanger 62 is loosely supported along by the upper edge 64 and slid to snugly accommodate and support a double wide joist resting in the left joist hanger 10 and subsequently fastened through the left and right joist hangers as previously described. Thus support for various widths of joists is provided.

Figure 5:
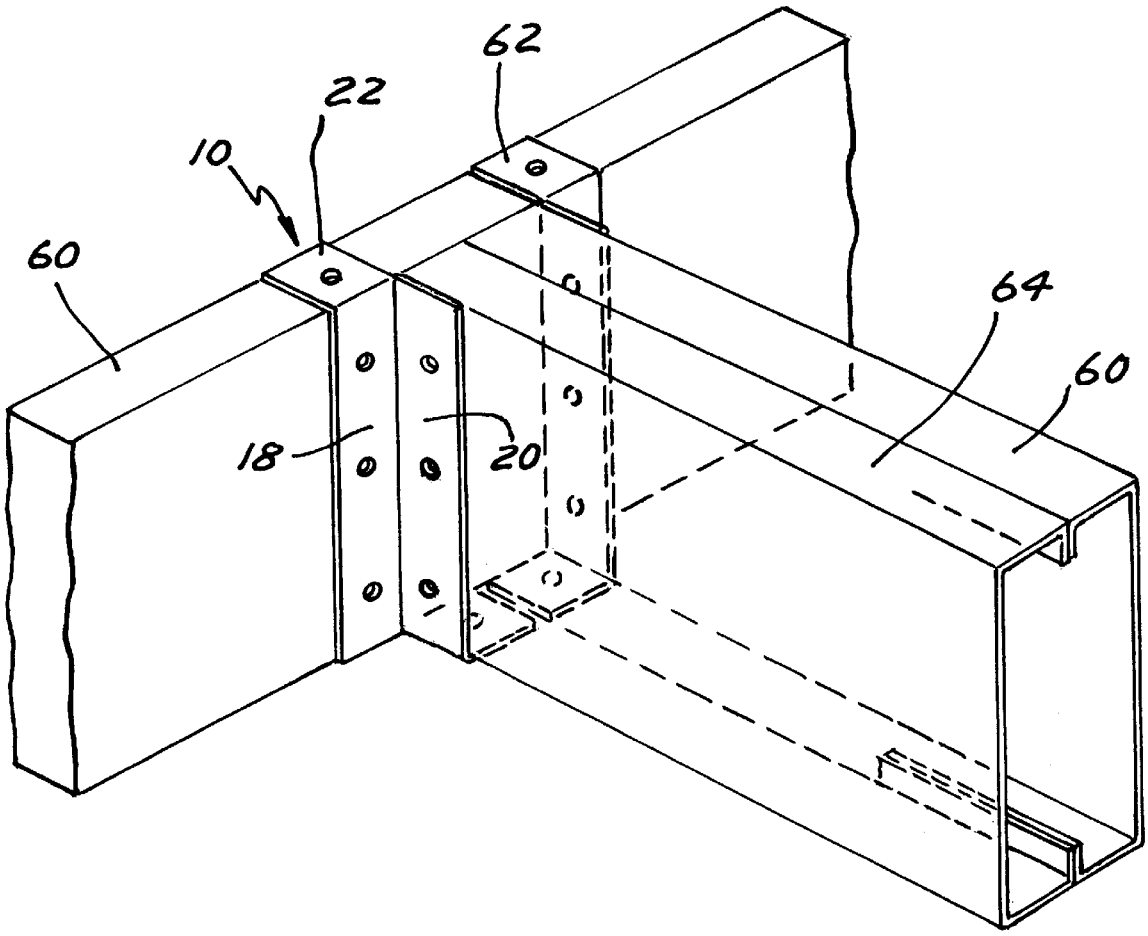
FIG. 5 illustrates a double wide joist supported by left and right joist hangers; and, FIG. 6, an alternate embodiment, illustrates a joist hanger.

FIG. 5 illustrates a double wide metal joist including joist member 64 and 66 supported by the left and right joist hangers 10 and 62 where all numerals correspond to those elements previously described.

Figure 6:
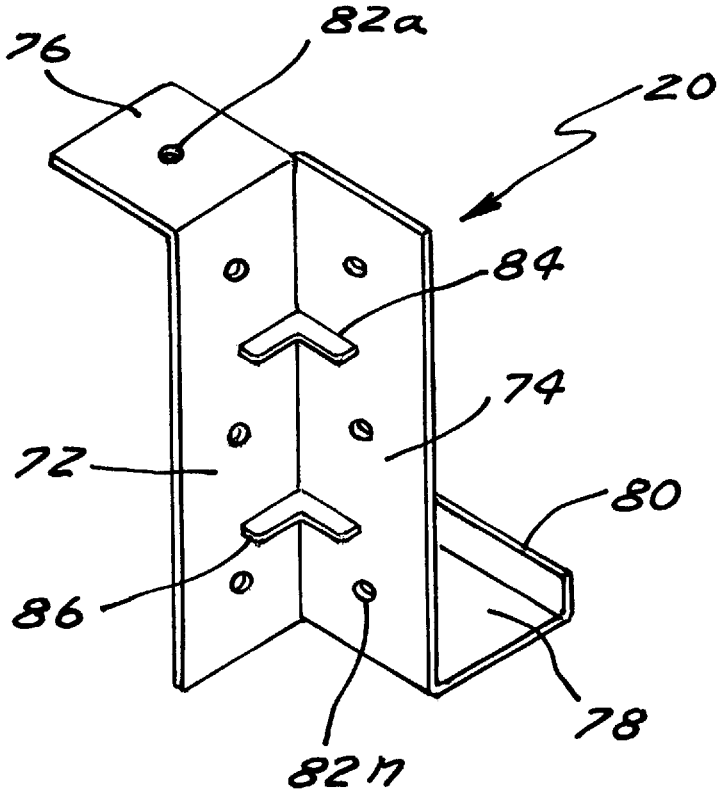

FIG. 6, an alternative embodiment, illustrates a joist hanger 70 similar in construction to the joist hangers previously described but having additional features as described herein and where all numerals correspond to those elements previously described. The joist hanger 70 includes vertical planar members 72 and 74, an upper planar tab member 76 extending horizontally and at a right angle to the upper region of the planar member 72, a lower planar tab member 78 extending horizontally from and at a right angle to the lower region of the planar member 74 and also including a vertically aligned tab 80 extending from an edge of the lower planar tab member 78. The vertical tab 80 allows joist members to be placed and horizontally positioned between the tab 80 and the planar member 74 on the lower planar tab member 78. Tab 80 provides lateral support to help keep the joist in place on the lower planar tab member 78 prior to securement through a plurality of holes 82*a*–82*n*. Additional support is provided by a plurality of horizontally aligned gusset supports 84 and 86 between planar members 72 and 74.

JOIST HANGER

Parts List

10 joist hanger
12 vertical bend axis
14 upper horizontal bend axis
16 lower horizontal bend axis
18 planar member
20 planar member
22 upper planar tab member
24 lower planar tab member
26*a*–*n* holes
28*a*–*n* holes
30 hole
34 supporting member
36 vertical surface
38 horizontal surface
50 metal channel member
52 support member
60 support member
62 joist hanger
64 metal joist member
66 metal joist member
70 joist hanger
72 planar member
74 planar member
76 upper planar tab member
78 lower planar tab member
80 tab
82*a*–82*n* holes
84 gusset support
86 gusset support Various modifications can be made to the present invention without departing from the apparent scope hereof.

It is claimed:

1. A joist hanger comprising:

a. two planar members at a substantially right angle; and, b. opposing tab members extending at a substantially right angle for an opposing end of each of said planar members.

2. The joist hanger of claim 1 including, at least, one hole in each of said members and said tab members.

3. The joist hanger of claim 1 including at least one gusset support in said planar members.

4. The joist hanger of claim 1 including two joist hangers opposing each other for supporting one joist.

5. The joist hanger of claim 1 including two joist hangers opposing each other for supporting two joists.

6. A metal joist hanger comprising:

a. two planar members at a substantially right angle; and, b. opposing tab members extending at a substantially right angle for an opposing end of each of said planar members.

7. The joist hanger of claim 6 including, at least, one hole in each of said members and said tab members.

8. The joist hanger of claim 6 including at least one gusset support in said planar members.

9. The joist hanger of claim 6 including two joist hangers opposing each other for supporting one joist.

10. The joist hanger of claim 6 including two joist hangers opposing each other for supporting two joists.

11. A joist hanger comprising:

a. two planar members at a substantially right angle;

b. opposing tab members extending at a substantially right angle for an opposing end of each of said planar members; and, c. a hole in each of said planar members and each of said tab members.

12. The joist hanger of claim 11 including at least one gusset support in said planar members.

13. The joist hanger of claim 11 including two joist hangers opposing each other for supporting one joist.

14. The joist hanger of claim 11 including two joist hangers opposing each other for supporting two joists.

* * * * *